US006251035B1

(12) United States Patent
Fa

(10) Patent No.: US 6,251,035 B1
(45) Date of Patent: Jun. 26, 2001

(54) SOUND AND LIGHT EFFECTS BALL STRUCTURE

(76) Inventor: Hu-Liang Fa, No. 208, Jong-Pyng Road, Shern-Gang Hsiang, Tai-Chung Hsien (TW)

( * ) Notice: Subject to any disclaimer, the term of this patent is extended or adjusted under 35 U.S.C. 154(b) by 0 days.

(21) Appl. No.: 09/359,418

(22) Filed: Jul. 23, 1999

(51) Int. Cl.[7] ..... A63B 43/06
(52) U.S. Cl. ..... 473/570; 473/571
(58) Field of Search ..... 473/570, 571, 473/603, 604, 605, 607, 609; 446/219, 220

(56) References Cited

U.S. PATENT DOCUMENTS 4,133,528 * 1/1979 Koblick ..... 473/570
4,776,589 * 10/1988 Yang ..... 473/570
5,102,131 * 4/1992 Remington et al. ..... 473/570
5,316,293 * 5/1994 Hamilton ..... 473/570
5,609,411 * 3/1997 Wang ..... 473/570
5,725,445 * 3/1998 Kennedy et al. ..... 473/570
5,888,156 * 3/1999 Cmiel et al. ..... 473/570

* cited by examiner

*Primary Examiner*—Steven Wong
(74) *Attorney, Agent, or Firm*—Dougherty & Troxell

(57) ABSTRACT

A sound and light effects ball structure, in which a sound and light element is fitted. As the ball is thrown, the ball structure will emit a light and sound effect. Its principal features are its transparent inner bladder and its translucence. Also, the inner bladder is sewn into the outer ball skin. The invention's features is a suspended strap that is connected inside and between the upper and lower sides of the inner bladder. Additionally, the suspended strap's center is affixed with a balance-switching sound and light element. The sound and light element is controlled by a battery. When the ball is thrown, its movement causes the sound and light element to move and emit the sound and light effects, which will be passed through the translucent ball skin. Furthermore, since the said sound and light element is secured at the ball's central interior, the centrifugal force keeps the ball from wavering. Therefore, as the ball is thrown, it can maintain a balance and regardless of whether it's day or night, the ball structure will always produce its sound and light effects.

2 Claims, 4 Drawing Sheets

SOUND AND LIGHT EFFECTS BALL STRUCTURE

BACKGROUND OF TIE INVENTION (a) Field of the Invention

This invention pertains to a type of sound and light effects ball structure. Its primary features are its transparent inner bladder and its translucence. It is sewn into the exterior ball skin forming the core. Inside the top and bottom of the said inner bladder is affixed a suspended strap. Secured at the center of the suspended strap is a balance-switching sound and light element. When the ball shakes or is thrown, the said sound and light element will emit a sound and light. Additionally, when the ball is spinning and since the said light and sound element is secured at the ball's central interior, the centrifugal force keeps the ball from wavering. That is, the ball won't deviate from its central axis, which ensures a balanced throw of the ball. Therefore, as the ball is thrown, it can maintain a balance, providing a sound and light effects ball structure.

(b) Description of the Prior Art

Of the conventional types of illuminating toy balls, there are only two important forms. The first type of ball is coated with a fluorescent paint, allowing the ball to glow in the evening hours. However, this type of ball can only glow in the evening hours and does not illuminate in daylight. Also, fluorescent paint begins to peel away after some time and thus the ball becomes unable to glow. The other type of light illuminating ball has an electronic luminary object fastened to the ball's surface or placed within its interior. As the ball is thrown, it will emit a light. However, since the electronic luminary object isn't secured within the ball, when this type of plastic luminary ball is thrown, the luminary object does not move in conjunction with the ball's centrifugal force. This will create an inability to maintain an even throw, especially in the case of non-circular balls (e.g. balls used in North American football.) Should the ball be thrown slightly unbalanced, this will cause the ball to wobble unstably, making it impossible to control its speed and direction.

SUMMARY OF THE INVENTION

Due to the foregoing shortcomings, which create a variety of practical nuisances, the inventor conducted meticulous research. During this time, the inventor also conducted numerous tests and performed as many corrections before finally successfully developing a revolutionary product to eliminate the numerous aforementioned shortcomings of the conventional products. The Sound and Light Effects Ball Structure greatly improves the practical effects.

The primary purpose of this invention is to offer a ball structure that when thrown maintains a smooth flight and that has both sound and light effects. The said sound and light element is fastened onto the center of the suspended strap, and is then secured at the ball's central interior. When the ball is thrown, the sound and light element moves in conjunction with the centrifugal force, preventing the ball from wavering. That is the ball won't deviate from its central axis, thus ensuring a balanced throw of the ball. Therefore, as the ball is thrown, it can maintain a balance and regardless of whether it's day or night, the ball structure will always produce sound and light effects.

The secondary purpose of this invention is to offer a type of sound and light effects ball structure. The principal feature is an inner bladder. This inner bladder is sewn into the outer ball skin. The inner bladder's upper and lower edges connect and envelop a suspended strap. Also, at the center of the suspended strap is affixed the balance-switching sound and light element. Additionally, the said sound and light element may be controlled with a battery. When the balance is lost, it will emit a light and a sound. Therefore, when the ball is thrown, the ball's shaking will cause the sound and light element to lose its level, which in turn will cause the ball to produce a sound and light effect.

BRIEF DESCRIPTION OF THE DRAWINGS

The following drawings and detailed descriptions are provided to gain a clear and accurate understanding of the invention's structure, features, effects and its purpose.

DESCRIPTION OF THE PREFERRED EMBODIMENT

Figure 1:
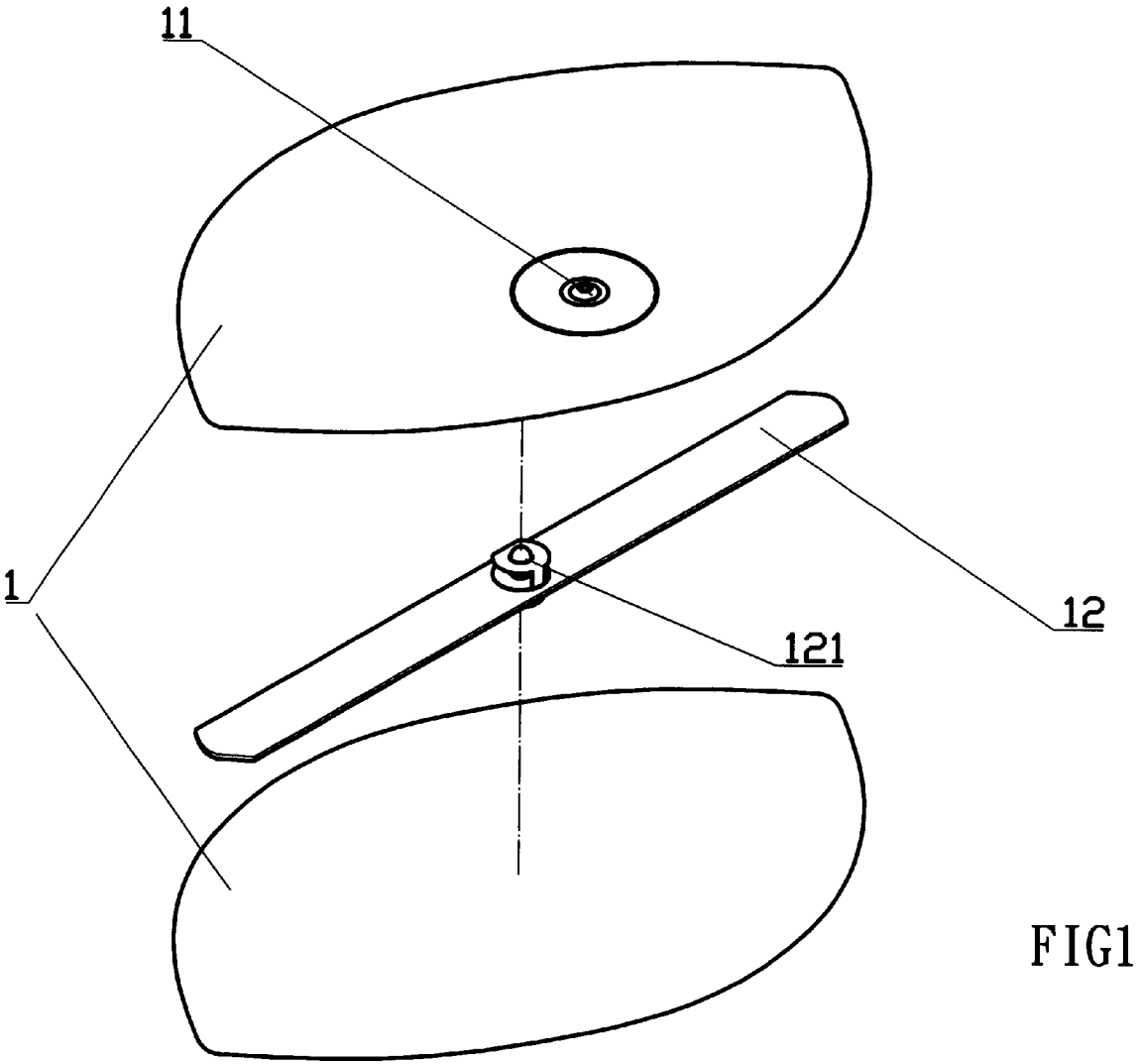
FIG. 1 is a sectional drawing of the inner bladder's positioning.
Figure 2:
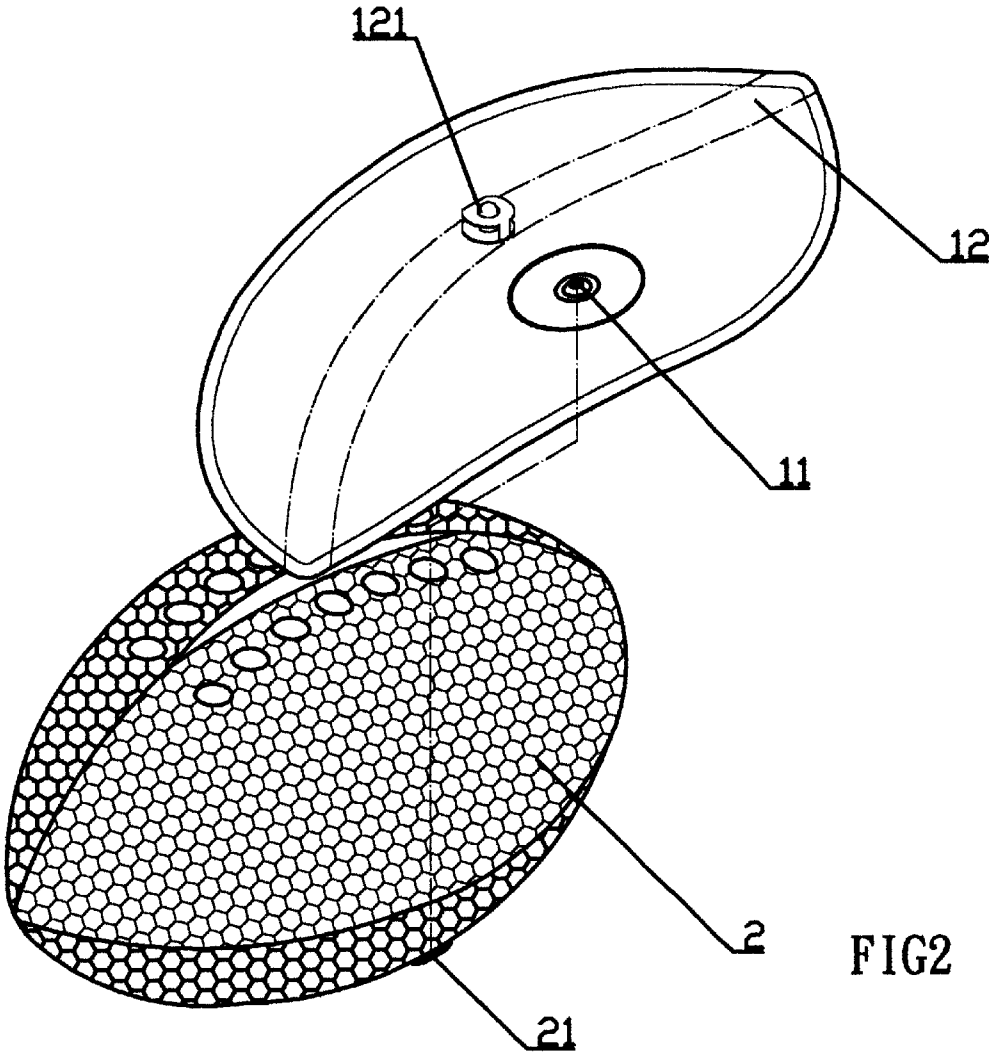
FIG. 2 is a sectional drawing of the invention's embodiments.
Figure 3:
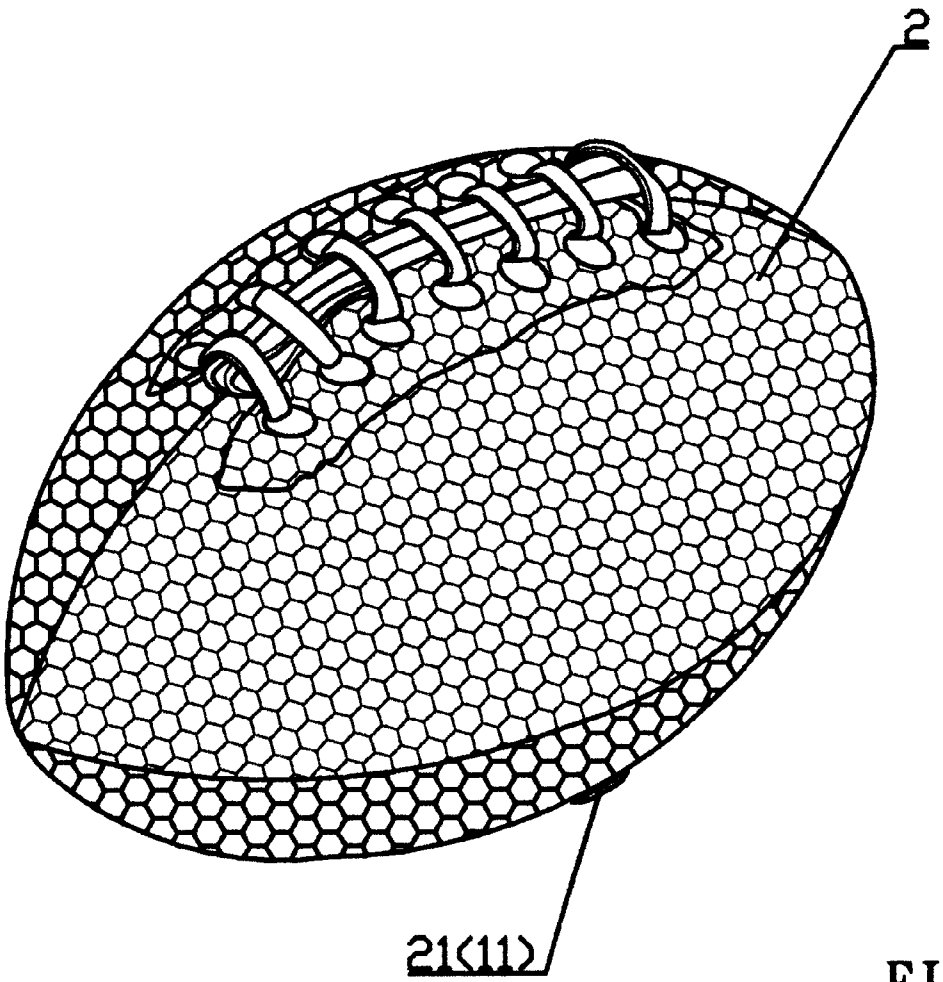
FIG. 3 is an external perspective of the invention.

Please refer to FIGS. 1, 2, and 3 for a clear understanding of the invention's structural form. The primary features are its transparent form, as well as on its outside, in a suitable location, is the air holed 11 inner bladder 1 and its translucence. The inner bladder 1 is aligned with the positioning of the air hole 21, then sewn into the exterior ball skin 2. This assembly allows the inner bladder 1 to placed into the ball skin 2 and pumped with air.

The invention's features consist of the said inner bladder 1, which is fused into a single unit. This is done by placing the suspended strap inside and between the upper and lower edges of the inner bladder 1, then adhering them to form a single unit. Additionally, at the center of the suspended strap 12, a balance-switching sound and light element 121 is secured. The said sound and light element 121 can be electronically controlled, thus when it is not level, it will emit light or sound.

Figure 4:
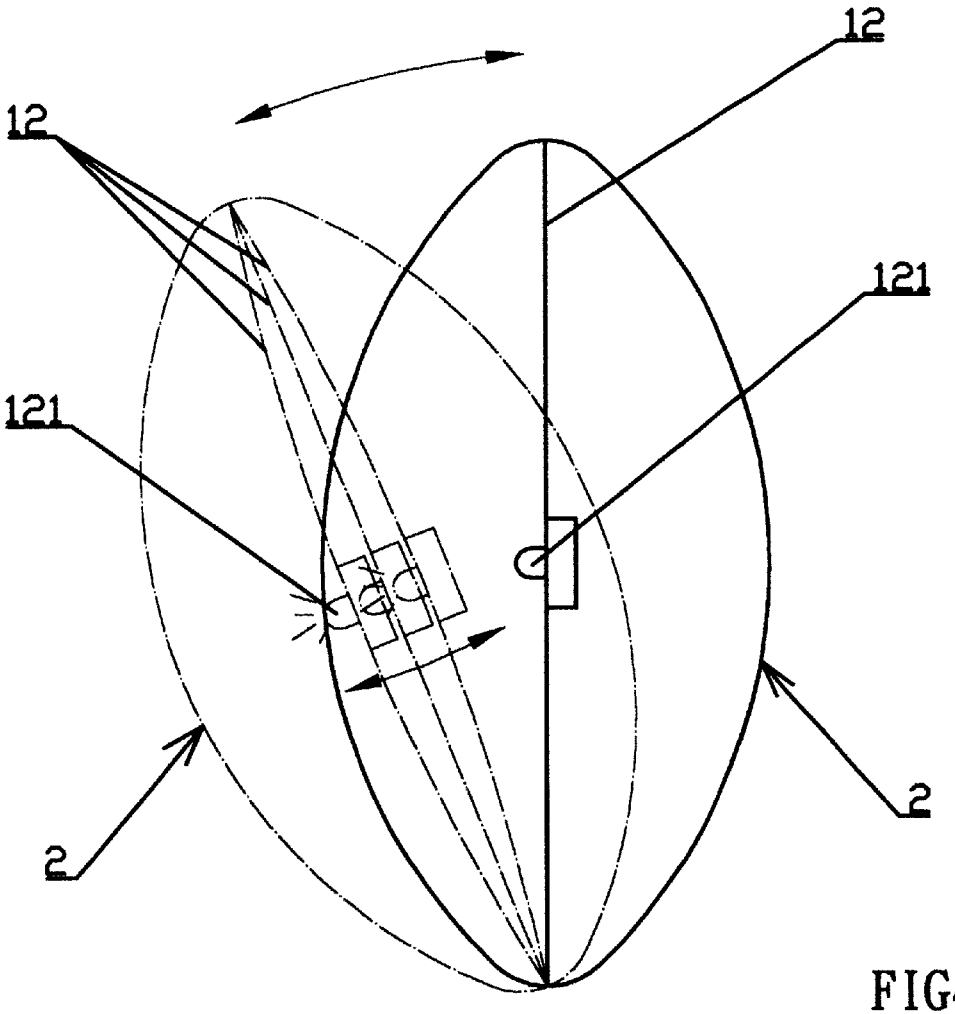
FIG. 4 is a perspective view of the invention as the ball is shaking.

Please refer to FIG. 4, which is a perspective view of the invention as the ball is shaking. When the ball is thrown it will shake, causing the sound and light element 121 to become unlevel, which will in turn produce the sound and light effect. As the ball skin 2 is translucent this effect will pass through it Additionally, when the ball is spinning and since the said light and sound element 121 is secured at the ball's central interior, the centrifugal force keeps the ball from wavering. That is the ball won't deviate from its central axis, and ensures a balanced throw of the ball. Therefore, as the ball is thrown, it can maintain a balance and regardless of whether it's day or night, the ball structure will always produce its sound and light effects.

In accordance with the foregoing, the sound and light effects ball structure embodies special structural features. This allows a realization of the desired basic purposes and greatly improves its practical use over conventional products. It is apparent that this fully meets the established conditions for novelty and is in accordance with patent application laws. It is hoped that this case will be duly processed in accordance with the applicable laws and granted a patent at an early date.

What is claimed is:

1. An inflatable toy ball having sound and light effects comprising:

a) a translucent outer ball skin in the shape of a prolate spheroid with pointed, opposite first ends;

b) a translucent, inflatable inner bladder located within the outer ball skin, the inflatable inner bladder having a prolate spheroid shape with pointed, opposite second ends, the inflatable inner bladder bounding an interior;

c) an elongated, flat suspending strap suspended in the interior, attached to and extending between the opposite second ends;

d) a sound and light emitting device mounted on the suspended strap and located in a central portion of the interior such that the sound and light emitting device is movable relative to the inner bladder; and e) an air inflation hole through the outer ball skin and the inner bladder to enable the inner bladder to be inflated with air.

2. The inflatable toy ball of claim 1 wherein the inflatable inner bladder comprises upper and lower portions joined together.

* * * * *